US006199410B1

(12) United States Patent
Rock et al.

(10) Patent No.: US 6,199,410 B1
(45) Date of Patent: Mar. 13, 2001

(54) DOUBLE FACE WARP KNIT FABRIC WITH TWO-SIDE EFFECT

(75) Inventors: Moshe Rock, Andover, MA (US); Karl Lohmueller, Hampstead, NH (US)

(73) Assignee: Malden Mills Industries, Inc., Lawrence, MA (US)

( * ) Notice: Subject to any disclaimer, the term of this patent is extended or adjusted under 35 U.S.C. 154(b) by 0 days.

(21) Appl. No.: 09/438,241

(22) Filed: Nov. 12, 1999

Related U.S. Application Data

(63) Continuation of application No. 09/133,786, filed on Aug. 12, 1998.

(51) Int. Cl.[7] ..... D04B 21/00
(52) U.S. Cl. ..... 66/195; 442/304
(58) Field of Search ..... 66/194, 195, 196; 442/304, 318

(56) References Cited

U.S. PATENT DOCUMENTS 5,855,125 * 1/1999 Lohmueller et al. ..... 66/196

* cited by examiner

*Primary Examiner*—Danny Worrell
*Assistant Examiner*—Robert H. Muromoto, Jr.
(74) *Attorney, Agent, or Firm*—Gottlieb Rackman & Reisman

(57) ABSTRACT

A fabric with a patterned velvet on one face and a different patterned velour on the other is formed from a three dimensional fabric using a double bar knitting machine. Preferably, at least either the stitching or backing yarn within the fabrics is made with a bulk high enough so that after the three dimensional structure is knitted and split, the back can be napped to form the velour from such yarn.

15 Claims, 4 Drawing Sheets

DOUBLE FACE WARP KNIT FABRIC WITH TWO-SIDE EFFECT

This application is a continuation of Ser. No. 09/133,786, filed Aug. 12, 1998.

BACKGROUND OF THE INVENTION

A. Field of Invention

This invention pertains to a warp knit fabric having velvet finish on one side with a preselected pattern and a velour finish on the second side, as well as a method for making the same.

B. Description of the Prior Art

A method of making a nappable knit fabric on a double needle bar knitting machine is known in which from five to eight yarn guide bars are used to knit fabrics simultaneously. After knitting, the fabrics are separated by cutting the interconnecting pile yarns. The pile yarns are carried by the middle or inner bars (for example, bars three, four and five on a seven bar arrangement) which tie the front and the back support fabrics together. These are also the yarns which are disposed on the technical face of each fabric and are used to give the fabric a particular characteristic and aesthetic value such as pattern, softness, luster, hand, resiliency, fullness, bulk and warmth. These characteristics are generally achieved by selecting the proper pile yarn for these bars as well as by the movement of the bars.

However, these inner yarns do not contribute to the dimensional stability and strength of the fabric. Physical characteristics are provided in known fabrics by the backing yarns which are normally thinner and less bulky than the pile yarns on the middle bars. Their main purpose is to form the fabric substrate, hold the fabric together, as well as to provide dimensional stability. Therefore, in known fabrics, these yarns are positioned, sized and arranged so that they are substantially invisible.

A disadvantage of this construction, known in the art, is that the technical face of the fabric is not nappable by itself, but only by pulling pile yarn from the technical back with the result that these fabrics have a velour finish on the technical face with the same pattern and composition as the velvet finish on the technical back.

SUMMARY OF THE INVENTION

It is an object of the present invention to provide a double knit fabric with a nappable velour finish on one side (the technical face) and a velvet finish, contrasting in color, composition and pattern, on the second side (the technical back).

A further object is to provide a method of making a double sided knit fabric using a multi-bar knitting machine wherein the knit construction is designed, by changing the movements of the end guide bars, to ensure that the fabric has a desired dimensional stability and/or flexibility.

Other objects and advantages of the invention shall become apparent from the following description.

Briefly, a double faced knit fabric is made by first knitting a three-dimensional fabric on a warp knitting machine using a plurality of guide bars. The three-dimensional fabric structure includes two support substrates interconnected by a plurality of pile yarns. Some of the guide bars provide the backing and stitching yarns. Other guide bars provide the pile yarns.

The three-dimensional structure is split into two fabrics, each having a technical face and a technical back. The technical face is napped or otherwise raised to form a velour. The technical back with the pile yarns is brushed to form a velvet.

Importantly, in order to provide a desired pattern of color or shapes on the technical face, different from that on the technical back, either the stitching or the backing yarns are made heavier than in the prior art so that they can be napped and hence provide fibers for the velour. Moreover, the inlay of the backing bars is changed to ensure that the corresponding yarns are nappable.

The resulting fabrics have a velour face which can be colored and patterned differently from the velvet.

DETAILED DESCRIPTION OF THE PREFERRED EMBODIMENT

Figure 1B:
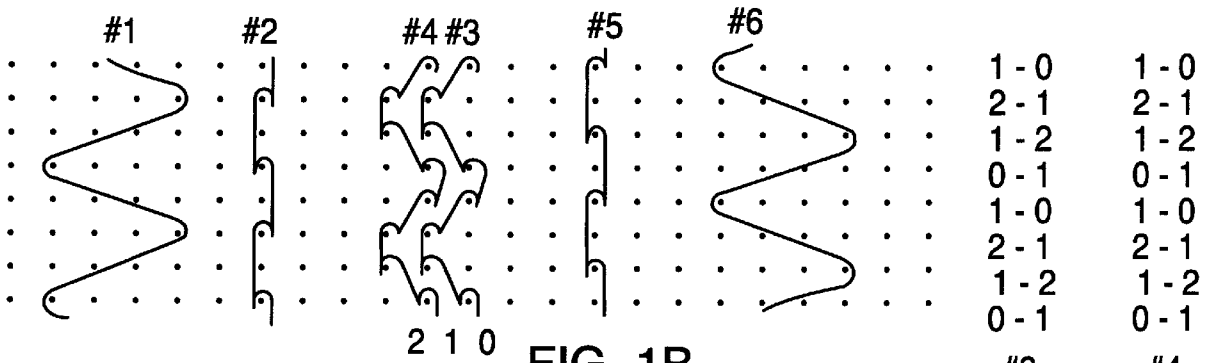
FIG. 1B PRIOR ART
FIGS. 1*a* and 1*b* show a lap diagram for knitting prior art fabrics.
Figure 1A:
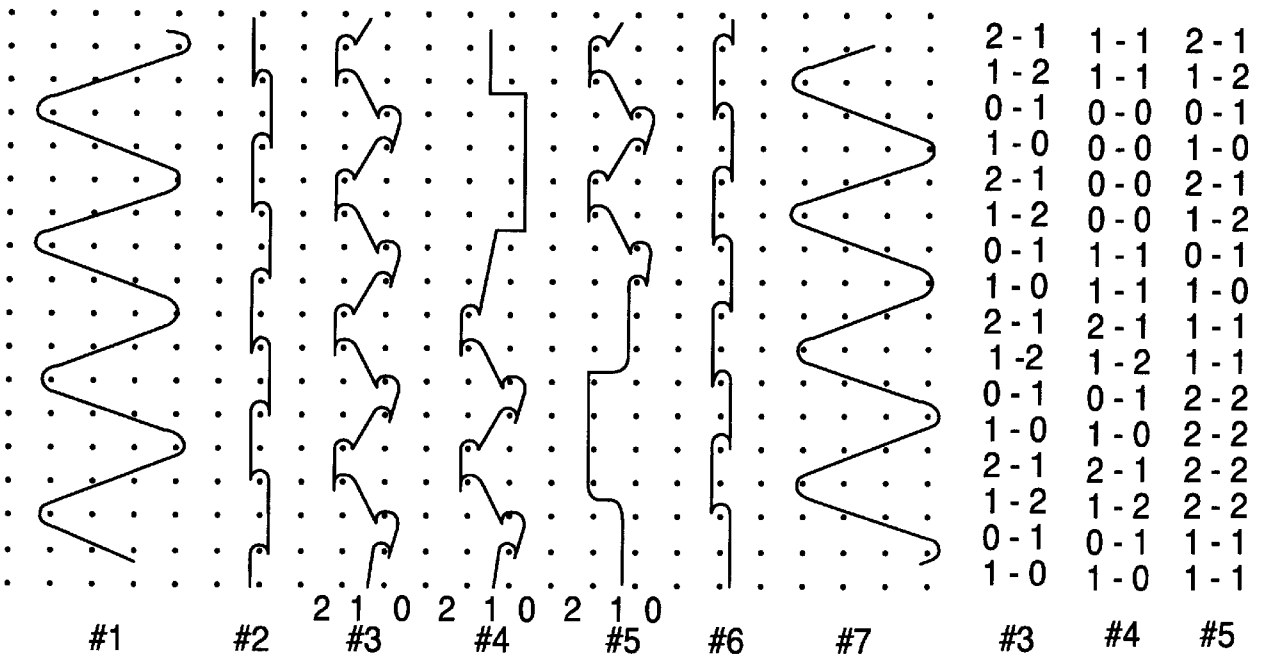
FIG. 1A PRIOR ART

FIG. 1 shows a standard pattern diagram for a prior art seven guide bar double needle bar raschel machine. As discussed above, in this arrangement, guide bars 1,2 and 6,7 form the front and back support substrates respectively while guide bars 3, 4 and 5 reciprocate between the support substrates to generate the pile yarns.

The yarns for end bars 1, 2, 6 and 7 are thinner and less bulky then the pile yarns. The yarns on end bars 1 and 7 are backing yarns 25, 26 and the yarns on end bars 2 and 6 are stitching yarns 17, 19. Because yarns 25 and 26 on end bars 1 and 7 are thinner and less bulky than the pile yarns on the middle bars 3, 4 and 5, they are covered by the pile yarns and are not nappable. A three-dimensional structure 11, knitted using this arrangement (see FIG. 4), is slit by cutting the pile yarns 21 into two fabrics, each having a face and a back. The back with the pile yarns is brushed to form a plush velvet. The face is left flat and smooth.

The present invention, in contrast, provides a different arrangement. First, the backing yarns for bars 1 and 7 are made from the same type of yarns, in quality, bulk and thickness, as the pile yarns for intermediate guide bars 3, 4 and 5. In this manner, contrary to the prior art, the backing yarns on guide bars 1 and 7 are not hidden, but are exposed on the technical face. Therefore, when the face is napped, the fibers forming the resulting fleece/velour are from the fibers of these backing yarns, and form a predetermined pattern on the velour which is different from any pattern on the velvet. Moreover, the backing yarns now cover the pile yarn pattern so that none of the pile yarn patter is pulled from the back to the face.

Figure 2:
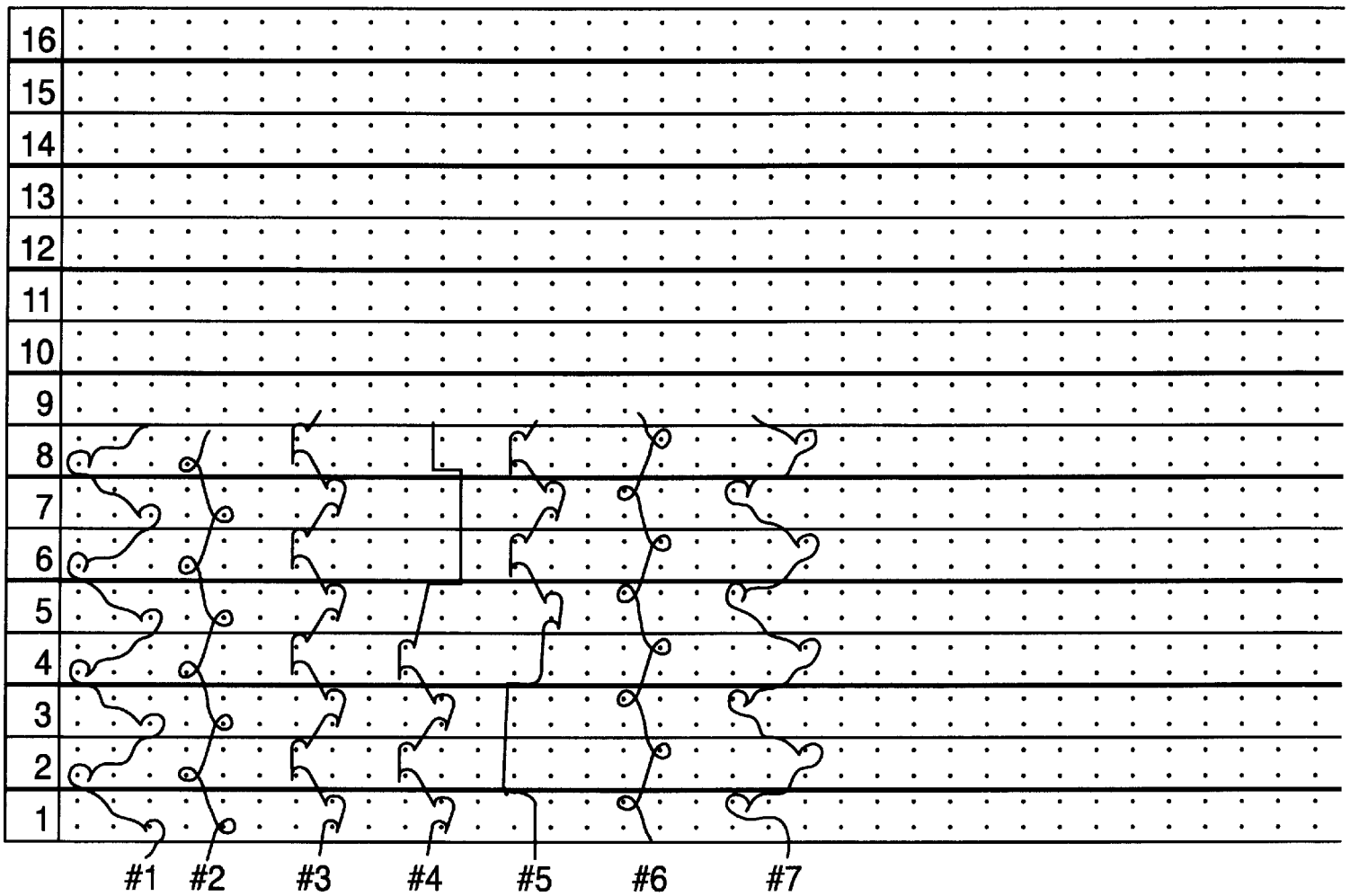
FIG. 2 shows a lap diagram for a first embodiment of the invention.

Second, the movement of the backing yarn guide bars is changed. As shown in FIG. 2, the movement of bars 1 and 7 is changed from a four needle underlap (shown in FIG. 1) to an open 2- and -1 lapping movement. Moreover, the movement of yarn guide bars 2 and 6 is changed from an open lap pillar stitch, normally used, to a closed 1- and -1 lapping movement. This change in guide bar movement ensures that the resulting fabric retains its strength and stability in both the warp and filling direction after the napping step. Moreover, the stitching yarns of yarn guide bars 2 and 6 remain hidden. They are, therefore, not touched by the napper wires during subsequent napping.

The arrangement shown in FIG. 2 is just one example of an arrangement that can be used to obtain a fabric with a velvet finish with a pattern on one side and a velour finish with a pattern on the other side. Further, the fabric can be made either more elastic or more dimensionally stable as desired by increasing or decreasing lap movement of guide bars 1, 2, 6 and 7.

Figure 3:
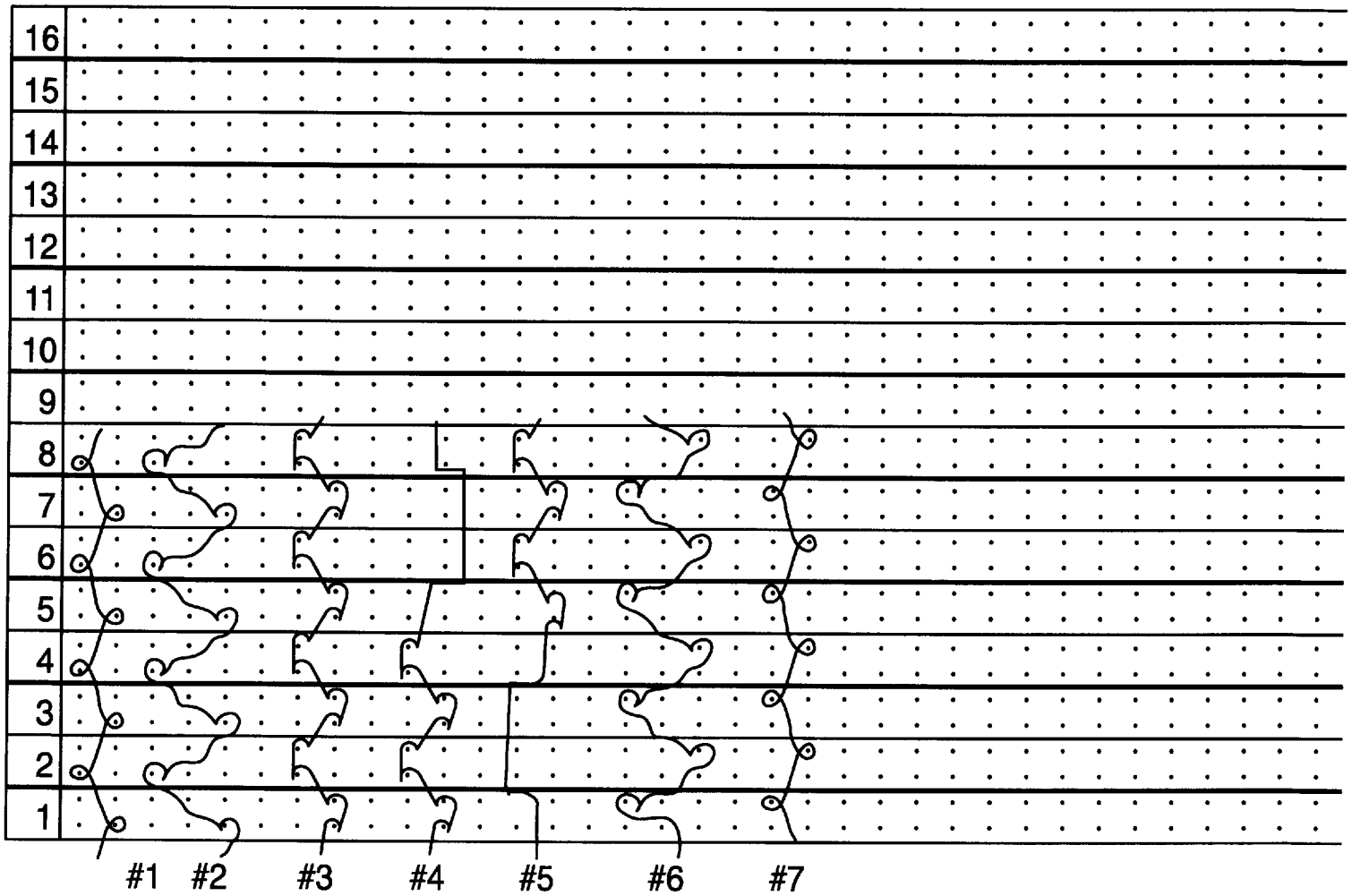
FIG. 3 shows a lap diagram for a second embodiment of the invention.

Alternatively, the bulk and quality of the stitching yarns can be increased so that they are nappable, while the backing yarns remain thin and hidden, as in the prior art. In this embodiment, a velour is formed on the face, which includes fibers from the stitching yarns. In addition, the backing yarns are hidden from the napper wires during the napping step. For this embodiment, the movement of the backing guides 1 and 7 and stitching guides 2 and 6 are interchanged as shown in FIG. 3, as compared to the arrangement shown in FIG. 2.

A large variety of yarns can be used to make the subject fabric. For example, polyester yarns can be used to make the velour. In addition, the yarns could be made of nylon, acrylic or polypropylene. In addition, combination yarns may also be used. For example, a polyester yarn may be used for the pile yarns, resulting in a polyester velvet on the back, while a cotton or wool yarn may be used for the remaining yarns resulting in a cotton or wool velour on the face.

Preferably a multifilament yarn with a yarn count in the range of 50 to 250 denier is used for the support substrates (for the stitching and backing yarns). The pile yarns forming the velvet can be spun or multifilament of 0.5 to 5 dpf and generally they are about 1.5–3.5 times heavier than the thinner yarns of the support fabric. Therefore, the pile yarns yield a plush velvet. Moreover, if the pile yarns are thinner than the backing yarns, the likelihood that they are pulled through the support substrate to the technical face is reduced.

The yarns to be napped (i.e., the backing yarn of FIG. 2 or the stitching yarn of FIG. 3) in order to produce the velour are preferably of a weight in the same range as the pile yarns. The heavier this yarn, the more velour is generated during napping.

In summary, a new and novel fabric is made in accordance with this invention which has a velvet on one side and a velour on the other, with the velour having a pattern resulting from the backing or stitching yarns. Preferably the novel fabric is made on a double needle multibar knitting machine which forms a three-dimensional structure including two parallel support substrates and pile yarns interconnected between the support substrates.

Advantageously, five or more guide bars are used on the machine in order to provide a backing yarn and a stitching yarn cooperating with a plurality of warp yarns to form the support substrates. The remaining bar guides provide the pile yarns which are reciprocated back and forth between the two support substrates.

Importantly, the pile yarns and one of the backing or stitching yarns are made of a heavier and bulkier filament.

Figure 4:
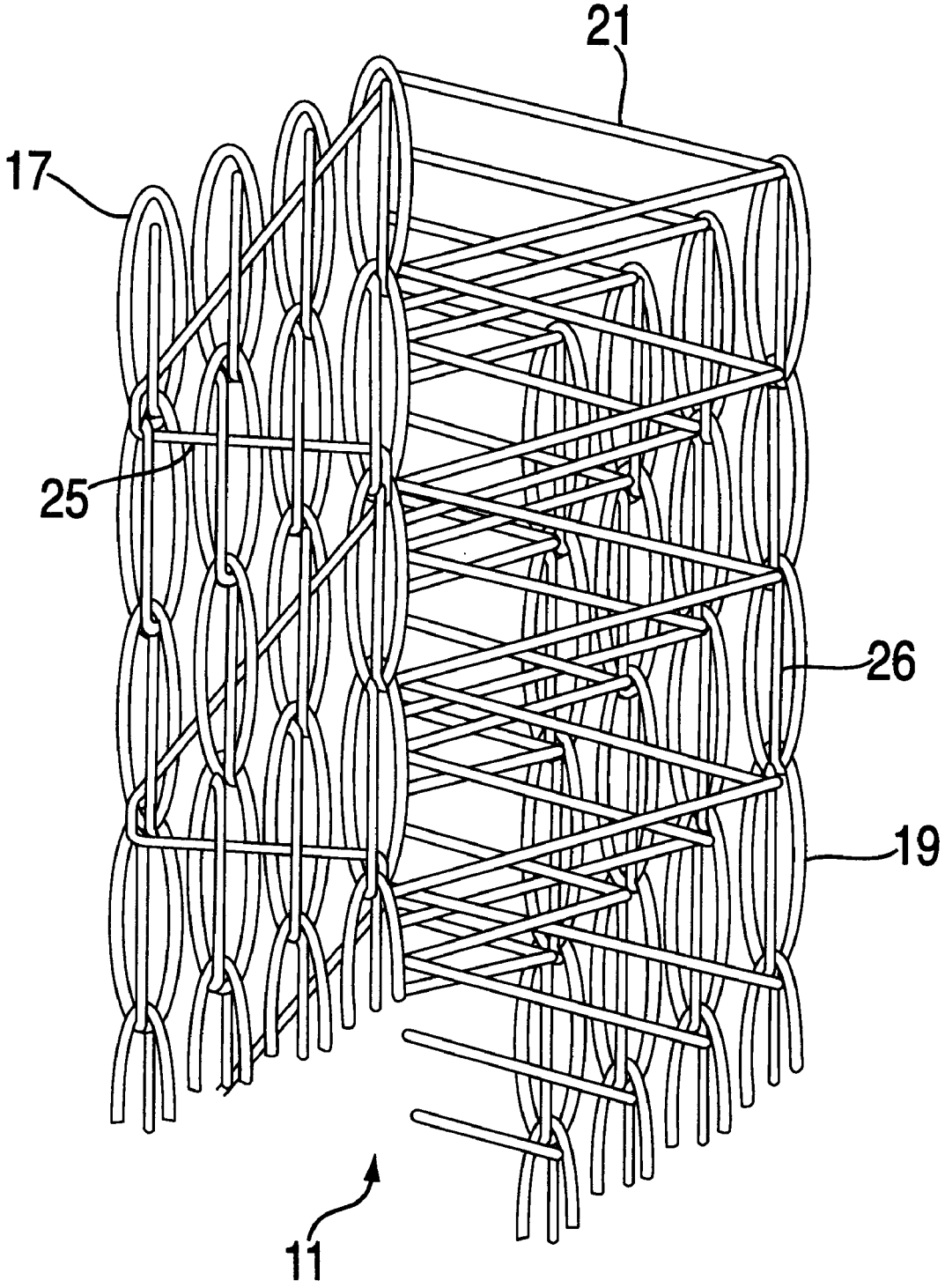
FIG. 4 shows a cross-sectional view of a three-dimensional fabric structure prior to cutting.

Typically, after the three-dimensional structure is completed, it is split into two fabrics (as shown in FIG. 4) by cutting the pile yarns. The back on each resulting fabric with the pile yarns is brushed to form the velvet and the face of each fabric is mechanically treated, for example by using a napping device, in order to form a velour-type surface.

Obviously numerous modifications may be made to the invention without departing from its scope as defined in the appended claims.

What is claimed is:

1. A three-dimensional knit fabric structure comprising first and second support fabrics each made from stitching yarns and backing yarns and each defining a face and back;

a plurality of pile yarns extending between the backs of said support fabrics;

wherein one of said stitching and backing yarns covers said pile yarns along said faces of said support fabrics so that only said one of said stitching and said backing yarns is capable of being raised along said faces such that said one of said stitching and backing yarns is exposed along said faces to produce a velour on each of said fabric faces.

2. A method of making a fabric with a velour on one side and a velvet on the other side on a double bar knitting machine comprising the steps of:

knitting a three-dimensional fabric structure on said knitting machine, said structure having two support fabric substrates made from backing yarns and stitching yarns and each defined by a face and a back;

covering along said faces a plurality of pile yarns extending between said substrates by said one of said backing and said stitching yarns;

splitting said structure by cutting said pile yarns to form two fabrics, said pile yarns extending from said backs of each of said substrates in order to form a velvet; and processing said faces so as to raise only said one of the stitching yarns and the backing yarns in order to to form a velour.

3. The method of claim 2, wherein said pile yarns have a bulk about 1.5 to 3.5 times larger than that of said other of said stitching yarns and said backing yarns.

4. The method of claim 2, wherein said knitting machine includes at least two backing guide bars and a plurality of intermediate bars, each said backing guide bar providing said backing yarns and said intermediate bars providing said pile yarns.

5. The fabric structure of claim 1, wherein each of said stitching and said backing yarns is made from a multifilament yarn with a yarn count in the range of between about 50 and 250 denier.

6. The fabric structure of claim 1, wherein the pile yarns are either spun or multi-filament.

7. The fabric structure of claim 1, wherein the pile yarns are between about 0.5 and 5 dpf.

8. The method of claim 2, wherein said treating step comprises napping said one of the stitching yarns and the backing yarns along said other surface of each said substrate.

9. A three-dimensional knit fabric structure comprising first and second support fabrics each made from stitching yarns and backing yarns, and each defining a face and a back;

a plurality of pile yarns extending between the backs of said support fabrics;

wherein one of said stitching and backing yarns covers said pile yarns along said faces of said fabrics so that only said one of said stitching and backing yams are capable of being raised from said faces.

10. The fabric structure of claim 9, wherein said pile yarns have a bulk between about 1.5 and 3.5 times larger than the other of said stitching and backing yarns.

11. The structure of claim 1, wherein said pile yarns have a bulk between about 1.5 and 3.5 times larger than that of the other of said stitching and backing yarns.

12. The structure of claim 1, wherein said one of said stitching and said backing yarns has a bulk approximately the same as that of said pile yarns.

13. The method of claim 1, wherein said one of said backing and said stitching yams has a bulk which is large enough for covering said pile yarns along said faces.

14. The method of claim 1, wherein said fabric structure is knit utilizing a plurality of guide bars.

15. The method of claim 14, wherein said guide bars have a movement which is adjusted for exposing said one of said stitching and said backing yarns along said faces.

* * * * *